US006666372B1

(12) United States Patent
Nagel

(10) Patent No.: US 6,666,372 B1
(45) Date of Patent: Dec. 23, 2003

(54) ILLUMINATED MAILBOX

(76) Inventor: Matthew T. Nagel, P.O. Box 403, Blairstown, NJ (US) 07825

( * ) Notice: Subject to any disclaimer, the term of this patent is extended or adjusted under 35 U.S.C. 154(b) by 0 days.

(21) Appl. No.: 10/128,911

(22) Filed: Apr. 23, 2002

(51) Int. Cl.[7] ..... B65G 11/04
(52) U.S. Cl. ..... 232/45; 40/566; 232/35
(58) Field of Search ..... 232/17, 45, 35; 40/566; 362/155; 340/569

(56) References Cited

U.S. PATENT DOCUMENTS 4,648,012 A * 3/1987 Pittman, II ..... 362/155
4,755,915 A * 7/1988 Rogers ..... 362/155
4,782,210 A * 11/1988 Nelson et al. ..... 219/121.52
4,868,543 A * 9/1989 Binkley ..... 340/569
5,239,305 A * 8/1993 Murphy et al. ..... 340/539.1
5,813,749 A * 9/1998 Sheldon ..... 362/155
5,917,411 A * 6/1999 Baggarly ..... 340/569
5,975,713 A * 11/1999 Brothers ..... 362/155
5,979,751 A * 11/1999 Maddox ..... 232/52
6,033,084 A * 3/2000 Burke ..... 362/155
6,046,675 A * 4/2000 Hanna ..... 340/569
6,102,548 A * 8/2000 Mantle et al. ..... 362/155
6,120,162 A * 9/2000 Guerrieri ..... 362/155
2002/0166756 A1 * 11/2002 Thompson ..... 200/61.52

* cited by examiner

*Primary Examiner*—William L. Miller
(74) *Attorney, Agent, or Firm*—Schweitzer Cornman Gross & Bondell LLP

(57) ABSTRACT

A device is provided, for automatically illuminating a mailbox upon opening. A small box illuminating assembly is secured to the inside of a mailbox door and changes position as the door is opening and closed. The box illuminating assembly includes a light source, such as an LED, a power source, preferably a battery, and a tilt-actuated switch, all housed within a small container. When the mailbox door is opened, the tilt-actuated switch closes to activate the light source and illuminate the inside of the mailbox. Preferably, the light source is disposed at an acute angle to the door, so as to direct its light into the mailbox when the door is opened sufficiently to allow the inside of the box to be examined.

2 Claims, 2 Drawing Sheets

ILLUMINATED MAILBOX

BACKGROUND OF THE INVENTION

The present invention is directed to a small, inexpensive device for illuminating the interior of a mailbox, when opened for inspection.

The typical rural mailbox consists of a somewhat elongated box housing, open at the front. A closure door is pivotally mounted along the bottom edge of the front of the housing and is movable from a generally vertical, box-closing position, to an open position pivoted forwardly at some suitable angle, for example, to a generally horizontal position.

At night, or in conditions of reduced visibility, it is sometimes difficult to see inside the box, to determine the nature of the contents, if any. This invention is directed to a novel, simplified, inexpensive and easily used device which functions automatically, when the mailbox door is opened, to illuminate the interior of the box, such that the user may easily ascertain the nature of its contents.

In accordance with one aspect of the invention, a mailbox illuminating device is provided which comprises a small support member, typically but not necessarily a box-like enclosure, which is fixed to the inside of the mailbox door. The support mounts a light source, such as a bright LED, a power source, typically a conventional battery, and a tilt actuated switch connecting the light source with the power source. When the mailbox door is in its upright or closed position, the tilt-actuated switch is in an open condition. When the mailbox door is pivoted downwardly to open the mailbox, the tilt-actuated switch is closed, energizing the light source and casting the desired illumination into the interior of the box. When the mailbox door is subsequently closed, the light is automatically extinguished by opening of the tilt-actuated switch. A timer optionally (and preferably) be incorporated in the switching circuit to interrupt the power source in the event that the mailbox door is left open for an extended time period.

For a more complete understanding of the above and other features and advantages of the invention, reference should be made to the following detailed description of a preferred embodiment, and to the accompanying drawings.

DESCRIPTION OF THE DRAWINGS

FIG. 3*a* is an enlarged, fragmentary sectional view of the encircled area of FIG. 3, illustrating the mounting and orientation of the illuminating device.

FIG. 4*a* is an enlarged, fragmentary sectional view of the encircled portion of FIG. 4.

DESCRIPTION OF THE PREFERRED EMBODIMENT OF THE INVENTION

Figure 1:
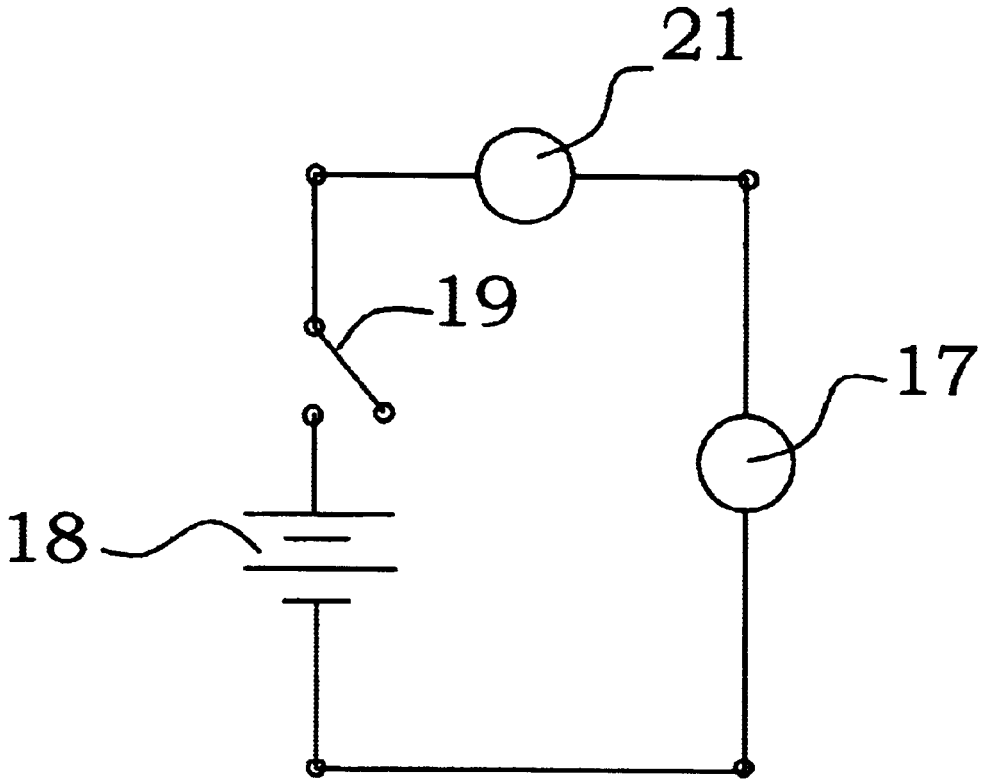
FIG. 1 is a simplified schematic circuit illustrating one preferred embodiment of the invention.
Figure 2:
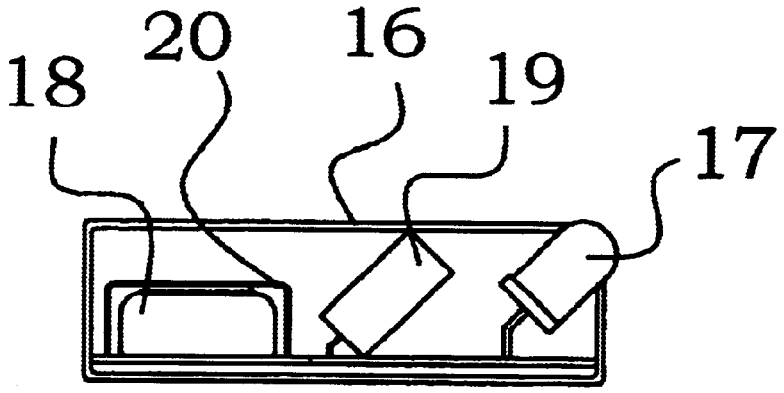
FIG. 2 is a cross sectional view of the illuminating device of the invention, showing internal structure of the housing or support.

Referring now to the drawing, the reference numeral 10 designates generally a typical rural mailbox comprising a housing 11 which is open at the front 12 and is provided with a closure door 13 hingedly connected at its lower edge to the lower front portion of the mailbox, by hinge pins 14.

Figure 3:
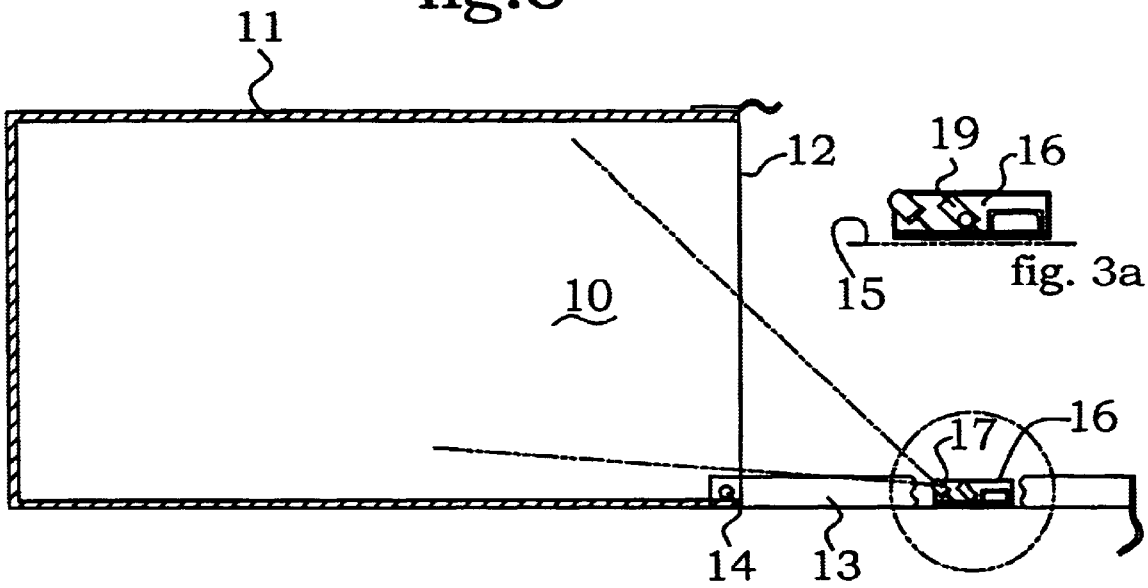
FIG. 3 is a side elevational view, with parts broken away, illustrating the manner in which the illuminating device is mounted on a mailbox door, illustrating the door in an open position.

Secured to an inside surface 15 of the mailbox door is a support 16 forming part of the illuminating device, typically in the form of a small enclosure, which conveniently may approximate the size of a cigarette package, for example. The support 16 may be secured to the door inner surface 15 by any suitable means, such as adhesive, Velcro, double-sided tape, screws, or the like. In whatever manner it is mounted, the support 16 moves with the door 13, as the latter is moved between its closed orientation (FIG. 4), and an open orientation (FIG. 3).

Suitably mounted within the support enclosure 16 is an illuminating system comprising a light source 17, a power source 18, typically in the form of a small battery, and a tilt-actuated switch 19. The battery 18 may be of a conventional type, for example, a typical 9-volt battery, which is mounted in a suitable battery holder 20, with conventional connections. The enclosure support 16 is provided with a suitable access door (not shown) for changing the battery 18 at the end of its useful life.

The tilt-actuated switch 19 can be of any conventionally available type, among which are mercury switches and mechanical tilt switches. In either type of tilt-actuated switch, orientation of the switch in one position causes switching element (liquid mercury in one case and a movable ball or other mechanical element in another) to move out of contact with a pair of switching elements, to interrupt the circuit. When the switch is in a second orientation, the mercury or mechanical element is moved by gravity to another position, in which it serves as a connecting medium between two conductors of the circuit. These devices are well known and readily available commercially.

Figure 4:
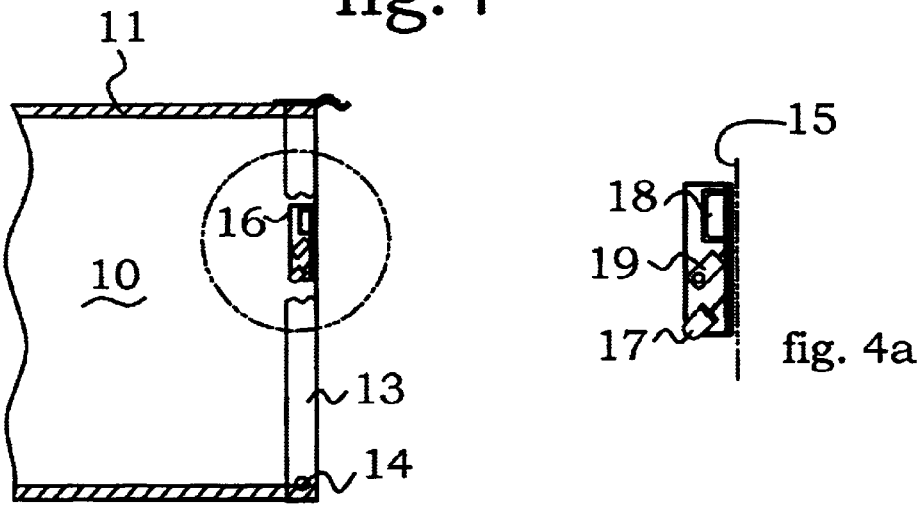
FIG. 4 is a view similar to FIG. 3, with the mailbox door in an upright or closed position.

In the device of the invention, the tilt-actuated switch 19 is orientated to be in the open or "off" position when the mailbox door, and thus the support enclosure 16 as well, are in an upright position, reflected in FIGS. 4 and 4*a*. In this configuration, the light source 17 is disconnected from the power source 18. As soon as the mailbox door 13 is opened by a predetermined angle, the movable medium of the tilt-actuated switch causes the circuit to be closed and the light source 17 to be energized. The tilt-actuated switch 19 preferably can be adjustably oriented within its supporting enclosure 16, in order to cause the light source 17 to be activated earlier or later in the opening movement of the mailbox door. In the illustrated arrangement, the tilt-actuated switch is oriented at an angle of about 45 degrees, for activating the light source as the mailbox door opens to a position of about 45 degrees of the vertical.

Desirably, as reflected in FIG. 3, the light source 17 is oriented such that, when actuated, it casts a beam of light into the interior of the mailbox. As a practical matter, the light cast from the light source 17 is not required to be in the nature of a focused beam, but to the extent that it has any directional characteristics, the light source can be oriented to be projected into the interior of the mailbox.

To particular advantage, the light source 17 is an LED device, which can be of a commercially available type. Such LED devices are known to be highly efficient in terms of the amount of light generated in relation to power consumed, so as to have a relatively extended life in the intended service environment.

In a particularly preferred form of the invention, the energizing circuit for the light source 17 includes a timing device 21 which serves to open the circuit after a predetermined time period, regardless of the orientation or condition of the tilt-actuated switch 19. Accordingly, if the mailbox door 13 is accidentally left open, the system will be deactivated after a short period to avoid excessive battery drain.

The device of the invention is very simple and inexpensively manufactured and can be arranged for installation on the inside surface of a mailbox in a moment's time, without tools. With appropriate adhesively mounted elements, installation may be as simple as peeling away a release sheet and pressing the device against the surface of the mailbox door. The device is lightweight, with a minimum profile protruding into the housing of the mailbox, and provides automatic illumination of the box for extended periods of use.

It should be understood, of course, that the specific forms of the invention herein illustrated and described are intended to be representative only, as certain changes may be made therein without departing from the clear teachings of the disclosure. Accordingly, reference should be made to the following appended claims in determining the full scope of the invention.

I claim:

1. An illuminated mailbox, which comprises:

(a) a mailbox having a mailbox housing with a front opening and a hinged door mounted for closing said front opening;

(b) said door being hingedly connected to said mailbox adjacent lower edge portions of said door and being pivotable outward and downward from a generally vertical box-closing position to an open position;

(c) a box illuminating assembly secured to said door, on an inside thereof, and movable with said door;

(d) said box illuminating assembly comprising a light source, a power source for energizing said light source, and a tilt actuated switch connected between said light source and said power source;

(e) said switch being actuated to an open condition when said door is in a generally vertical, box-closing position and to a closed condition when said door is pivoted outward to a box-opening position; and (f) a timing device actuating said switch into said open condition to extinguish said light source after a predetermined period of time.

2. The illuminated mailbox according to claim 1, wherein:

(a) said light source is an LED and said power source is a battery; and (b) said tilt actuated switch has a gravity operated element movable between switch-open and switch-closed conditions in accordance with the angle of orientation of said switch.

* * * * *